US008535453B1

(12) United States Patent
Gonzalez

(10) Patent No.: US 8,535,453 B1
(45) **Date of Patent: *Sep. 17, 2013**

(54) AUTOMATED PIPE CLEARING APPARATUS

(71) Applicant: AGCG Investments, Inc., Tampa, FL (US)

(72) Inventor: Alejandro Gonzalez, Tampa, FL (US)

(73) Assignee: AGCG Investments, Inc., Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/905,935

(22) Filed: May 30, 2013

Related U.S. Application Data

(63) Continuation-in-part of application No. 13/789,224, filed on Mar. 7, 2013.

(51) Int. Cl.
*B08B 9/00* (2006.01)
*B08B 9/035* (2006.01)

(52) U.S. Cl.
USPC ..... 134/166 C; 134/167 C; 134/168 C; 134/169 C

(58) Field of Classification Search
USPC ..... 134/166 C, 166 R, 167 C, 167 R, 134/168 C, 168 R, 169 C, 169 R
See application file for complete search history.

(56) References Cited

U.S. PATENT DOCUMENTS 4,962,778 A * 10/1990 Driskill ..... 134/169 C
5,085,244 A * 2/1992 Funk ..... 137/240
5,722,458 A * 3/1998 Potter ..... 137/625.47
6,041,611 A * 3/2000 Palmer ..... 62/286
6,068,023 A * 5/2000 Potter ..... 137/625.47
6,427,458 B1 * 8/2002 Fowler ..... 62/150
6,442,956 B1 * 9/2002 Herren ..... 62/150
6,701,740 B1 * 3/2004 Hernandez-Zelaya ..... 62/291
6,706,518 B2 * 3/2004 Lorenz et al. ..... 435/264
6,708,717 B1 * 3/2004 Coogle ..... 137/240
6,892,907 B2 * 5/2005 Varney ..... 222/527
6,976,367 B2 * 12/2005 Spanger ..... 62/129
7,392,658 B1 * 7/2008 Hardy, III ..... 62/78
7,624,756 B1 * 12/2009 Coogle ..... 137/558
7,857,004 B2 * 12/2010 Pearson ..... 137/899
2002/0023875 A1 * 2/2002 Lorenz et al. ..... 210/601
2002/0157708 A1 * 10/2002 Goff ..... 137/238
2005/0005625 A1 * 1/2005 Lee ..... 62/285
2005/0138939 A1 * 6/2005 Spanger ..... 62/150
2006/0042292 A1 * 3/2006 Kimbrough et al. ..... 62/285
2011/0308546 A1 * 12/2011 Kaiser ..... 134/18

* cited by examiner

*Primary Examiner* — Michael Barr
*Assistant Examiner* — Benjamin L Osterhout
(74) *Attorney, Agent, or Firm* — Andriy Lytvyn; Smith & Hopen, P.A.

(57) ABSTRACT

An automated pipe clearing apparatus for extracting matter contained within a drain pipe. The drain pipe clearing apparatus contains a vacuum pump having an inlet port and a discharge port. The inlet port is fluidly coupled to the drain pipe. A control module is in electrical communication with an electrical power source and the vacuum pump. The control module is programmed to actuate the vacuum pump at a predetermined time for a predetermined duration. The vacuum pump produces a suction to clear the drain pipe. The removed matter exits the vacuum pump through the discharge port. When the vacuum pump is not operating, gravity causes the drain pipe to continue normal draining.

8 Claims, 5 Drawing Sheets

AUTOMATED PIPE CLEARING APPARATUS

CROSS REFERENCE TO RELATED APPLICATION

This application is a continuation-in-part of U.S. patent application Ser. No. 13/789,224, entitled "AUTOMATED PIPE CLEARING APPARATUS," filed Mar. 7, 2013, which is herein incorporated by reference.

BACKGROUND OF THE INVENTION

1. Field of the Invention

This invention relates to pipe clearing devices. More specifically, it relates to an automated device for prophylactically clearing a pipe at predetermined times.

2. Brief Description of the Related Art

In almost every technological application, periodic preventive maintenance reduces the need for repairs and extends the life of equipment. This axiom holds true for the preventive maintenance of the fluid-carrying pipe systems. Specifically, a very prevalent problem associated with the central air conditioning and commercial refrigeration units is due to clogged drain pipes. The clogs are often caused by accumulation of dust, sludge, mold, algae, fungus, or a combination thereof within a drain line. A clogged pipe that is not detected in due time may overflow, causing extensive water damage to drywall and wooden beams. Overflowing drain pipes may also create health hazards by facilitating mold growth and producing foul odors inside the building.

Air handlers are commonly positioned in attics, where overflowing drain pipes may go unnoticed for a prolonged period of time. Often, the problem visually manifests itself only after the insulation and the ceiling are thoroughly soaked with the overflowing water, at which point, the damage may be substantial. Even upon detection of problems caused by a clogged overflowing drain pipe, the solution is not always simple or even apparent to many homeowners. A service call to a professional technician is one way of resolving the issue, but it may come at a fairly steep price. Moreover, the damage already caused by the overflowing water prior to detection of the problem may necessitate costly repairs.

Many expert technicians advise that periodic preventive maintenance is the most effective method for preventing the drain pipe from becoming clogged. Several techniques and devices are known in the art for prophylactically clearing out a pipe. Manually attaching an electric or mechanical vacuum pump to the outlet of the pipe and utilizing the suction to dislodge and remove clogs is perhaps the most common technique of clearing a pipe. Some currently available technologies, such as the rod-and-piston device disclosed in U.S. Pat. No. 6,427,458, require a fair amount of manual labor. Moreover, to be fully effective, preventive pipe clearing must be performed on a regular basis. Clearly, such preventive maintenance may be a time-consuming, dreadful, and burdensome task. Accordingly, what is needed is an automated pipe clearing apparatus that prophylactically clears the pipe without interfering with the pipe's normal drainage.

SUMMARY OF THE INVENTION

The long-standing but heretofore unfulfilled need for an automated pipe clearing apparatus for prophylactically clearing a pipe without disrupting its normal operation is now met by a new, useful, and nonobvious invention.

In one embodiment, the automatic pipe clearing apparatus has a housing that contains an electrical power source, a control module, and a vacuum pump. The vacuum pump has an inlet port and a discharge port, both ports protrude outside the housing. The inlet port is fluidly coupled to a drain conduit, such as an air-conditioning condensation drain pipe. When the vacuum pump operates, the produced suction dislodges and extracts liquid, debris, mold, algae, and other contents from the drain conduit.

The electrical power source supplies electrical current to the control module. The electrical power source may be photovoltaic module, a battery, a source of an alternating electrical current, a capacitor, or a combination thereof. The control module is programmed to actuate the vacuum pump at predetermined times for a predetermined duration.

In an embodiment, the pipe clearing apparatus may include a thermostat to prevent the device from actuating when the ambient temperature is below a predefined threshold.

In an embodiment, the vacuum pump may be a centrifugal pump. The centrifugal pump includes a vacuum pump housing, in which an impeller and an electric motor reside. The electric motor is in electrical communication with the control module and is adapted to drive the impeller. Rotation of the impeller creates a suction causing a fluid to flow into the vacuum pump housing through the inlet port and exit through the discharge port. The fluid flow removes the contents of the drain pipe which is coupled to the inlet port. When the electric motor is not operating, gravity causes the drain pipe to continue its normal operation, whereby the condensate exits the drain pipe, then enters the inlet port, flows through the impeller, and exits through the discharge port.

DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiment, reference is made to the accompanying drawings, which form a part hereof, and within which specific embodiments are shown by way of illustration by which the invention may be practiced. It is to be understood that other embodiments may be utilized and structural changes may be made without departing from the scope of the invention.

Figure 1:
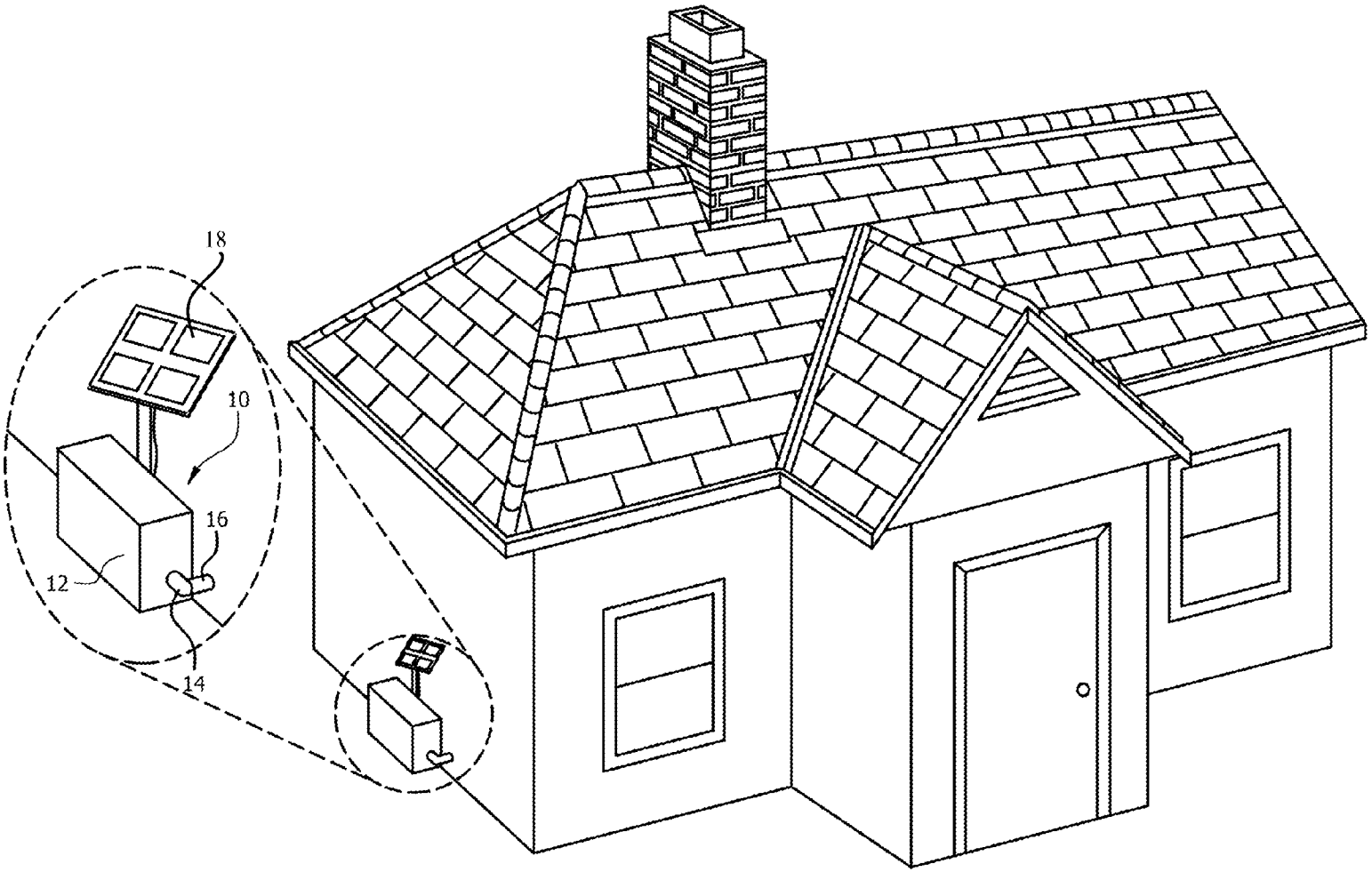
FIG. 1 is a perspective view of the automated pipe clearing apparatus attached to an exterior wall of a building.

Referring to FIG. 1, a pipe clearing apparatus 10 is shown in an attachment to an exterior wall of a house. This embodiment of pipe clearing apparatus 10 is intended for clearing out condensation drain pipes of central air conditioning (hereinafter "AC") units. However, pipe clearing apparatus 10 may also be adapted for clearing out other types of draining, venting, refrigeration, and exhaust systems.

As depicted in FIG. 1, pipe clearing apparatus 10 fixedly attaches to an exterior wall of a building. The attachment may be accomplished via any means commonly used in the art, including fasteners and adhesive. Pipe clearing apparatus 10 includes a pump 24 housed within housing 12. An inlet port 14 of pump 24 protrudes from housing 12 and is fluidly coupled to a discharge end of an AC condensation drain conduit 16. In most buildings equipped with central AC units, condensation drain conduit 16 protrudes from a lower part of an exterior wall allowing the condensate to drain outside the building. Pipe clearing apparatus 10 may be readily integrated into an existing AC condensation drain system without requiring any major modifications to the system itself.

Pipe clearing apparatus 10 may be powered by electricity generated by a photovoltaic module 18 and stored in a battery 22. Since the required clearings are relatively infrequent and quick, a fairly small and light battery 22 stores adequate amount of energy to ensure normal operation of pipe clearing apparatus 10. As shown in FIG. 1, photovoltaic module 18 may be raised to maximize the amount of solar radiation to which photovoltaic module 18 is exposed. In an alternative embodiment depicted in FIG. 2, photovoltaic module 18 may be attached directly to housing 12 of pipe clearing apparatus 10. This alternative, more compact configuration may be advantageous for those buildings where pipe clearing apparatus 10 is positioned in a place where it receives adequate amount of sunlight, thus eliminating the need to reposition photovoltaic module 18.

Photovoltaic module 18 provides a dual benefit: pipe clearing apparatus 10 is both environmentally-friendly and virtually maintenance free since there are no batteries to replace. This feature eliminates the need to monitor pipe clearing apparatus 10 because once it is installed and programmed, no subsequent maintenance is necessary. In alternative embodiments, standard batteries or an existing source of alternating electric current, such as a standard electrical outlet, may be used instead of photovoltaic module 18 and rechargeable battery 22.

Figure 2:
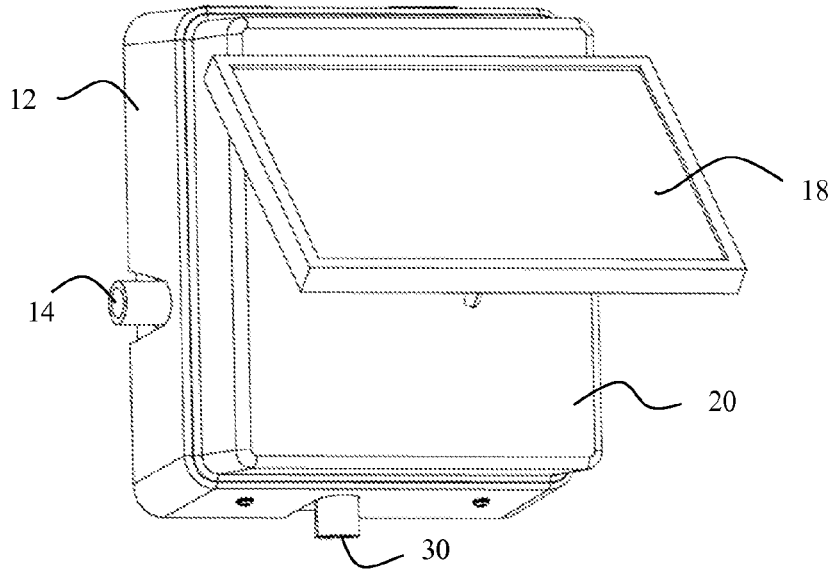
FIG. 2 is a perspective view of the automated pipe clearing apparatus with a photovoltaic module.

Referring to FIG. 2, housing 12 includes a cover 20. Cover 20 encloses components housed within housing 12, thus protecting them from environment, moisture, children, critters, etc. Cover 20 may be removed when access to interior of housing 12 or any of the components contained therein is needed.

Figure 3:
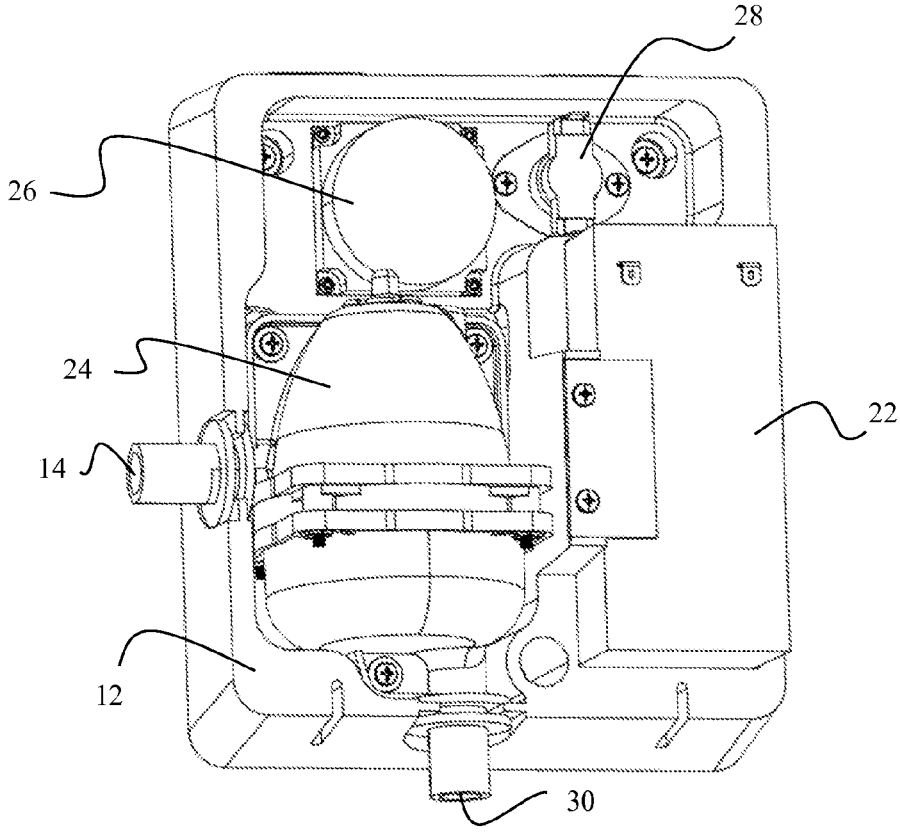
FIG. 3 is a perspective view of the automated pipe clearing apparatus with the cover removed exposing the components contained within the housing.

FIG. 3 depicts housing 12 with cover 20 removed, exposing pump 24, battery 22, a control module 26, and a thermostat 28. Housing 12 and cover 20 are preferably made out of a water impermeable and noncorrosive material, such as a plastic. Some examples of suitable plastics include polyethylene, polypropylene, polyethylene terephthalate, polyvinylchloride, polyvinylidenechloride, polycarbonate, polyurethane, polyamide, polytetrafluoroethylene, and polyvinylacetate. Noncorrosive metals such as aluminum, stainless steel, titanium, and alloys thereof may also be used. However, plastics are preferred due to their low cost, low weight, and ease of manufacturing.

Figure 4:
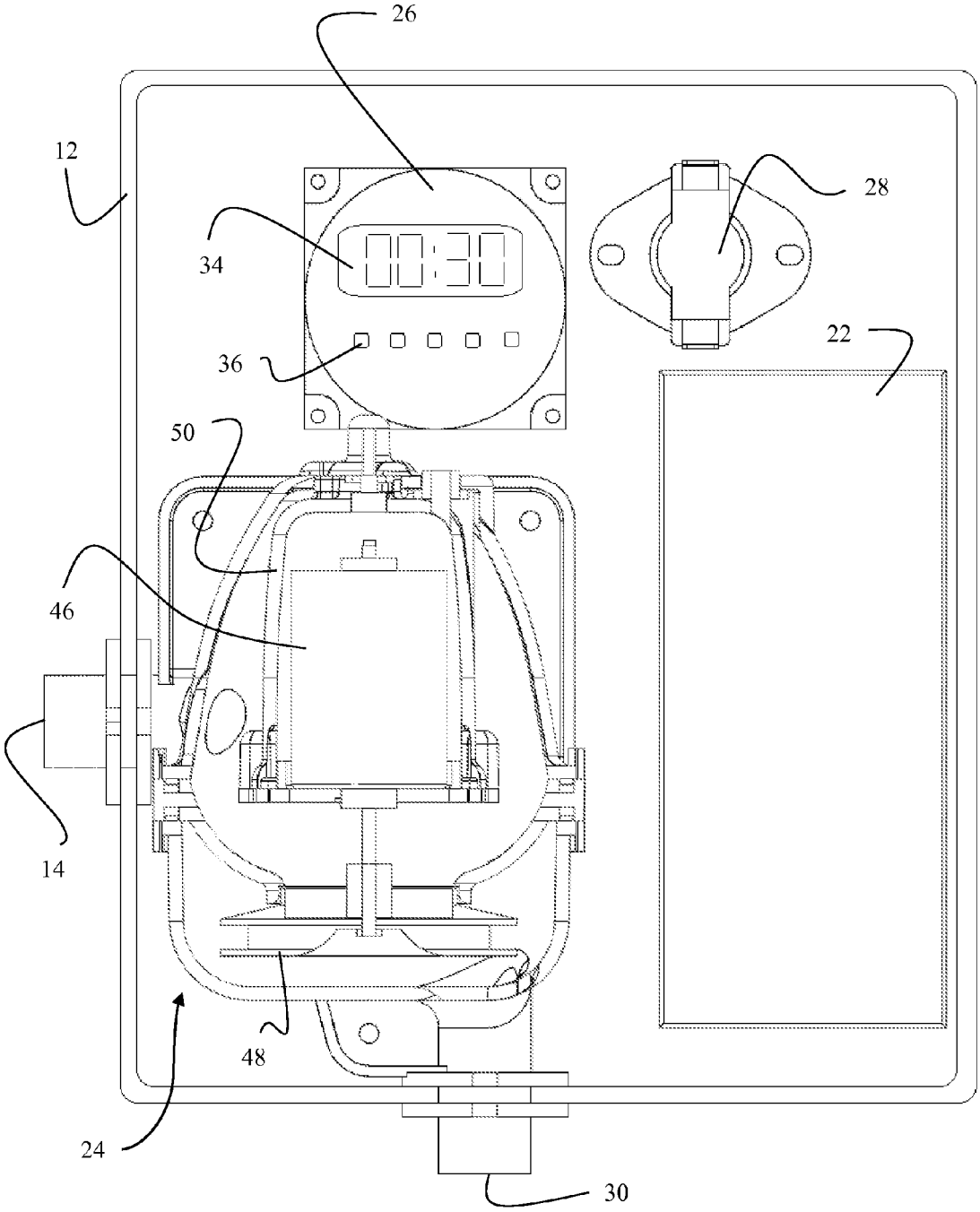
FIG. 4 is a cross sectional view of the automated pipe clearing apparatus depicting the functional components.
Figure 5:
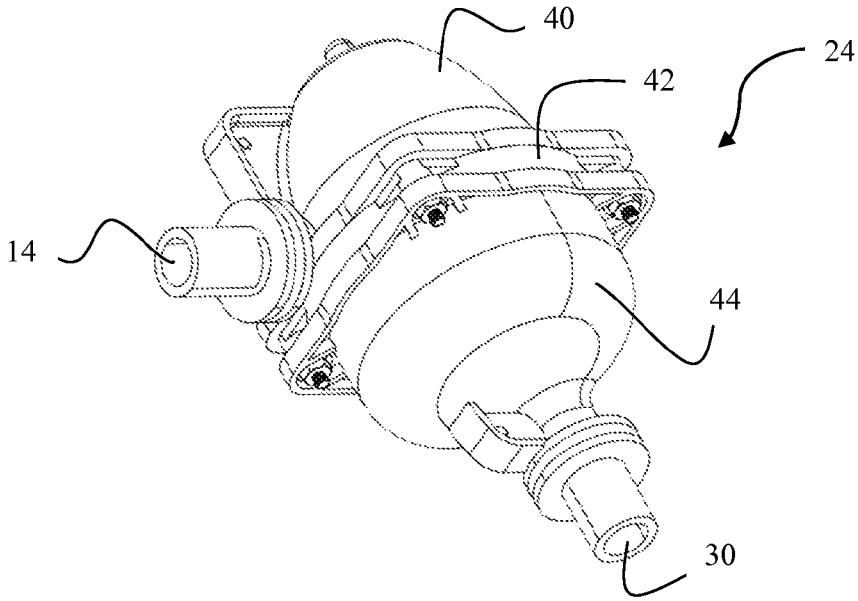
FIG. 5 is a perspective view of the vacuum pump.
Figure 6:
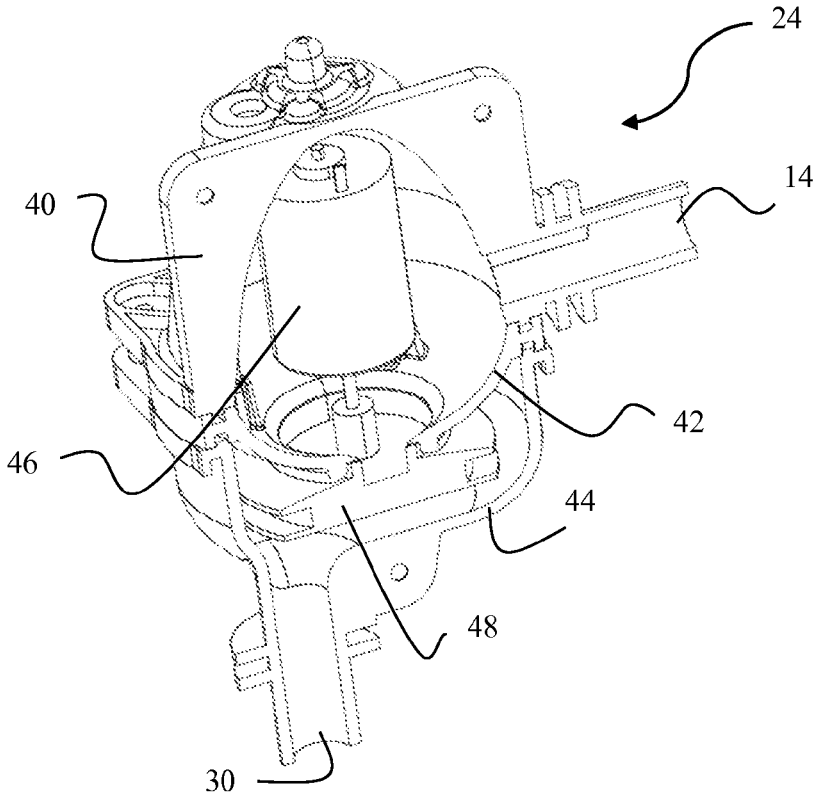
FIG. 6 is a cross-sectional perspective view of the vacuum pump.

Referring to FIG. 4, pump 24 has inlet port 14 and a discharge port 30. In its normal non-actuated state, pipe clearing apparatus 10 permits condensate discharged from AC condensation drain conduit 16 to pass through inlet port 14 and exit through discharge port 30. This feature permits the existing AC condensation drain system to maintain its normal functionality allowing the gravity to expel condensation from drain conduit 16, therefore, ensuring normal continuous drainage of the condensate even when pump 24 is not operating.

In the embodiment of the invention depicted in FIGS. 3-7, pump 24 is a centrifugal pump. Other embodiments may use other types of velocity vacuum pumps, such as axial-flow and mixed-flow pumps. Moreover, positive displacement pumps, such as internal gear, screw, shuttle block, flexible vane, sliding vane, circumferential piston, flexible impeller, helical twisted roots, and liquid ring vacuum pumps may also be used.

Figure 7:
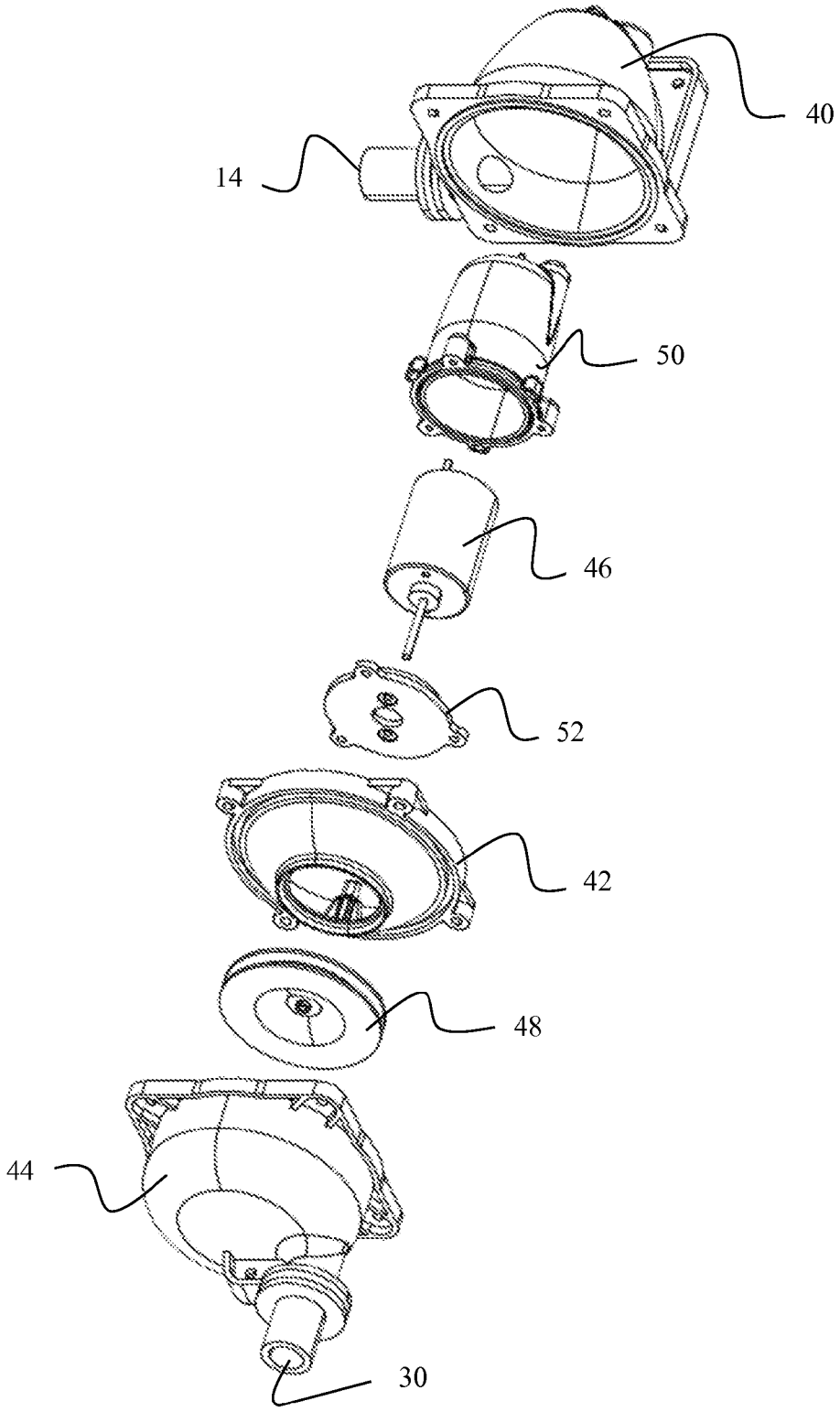
FIG. 7 is an exploded perspective view of the vacuum pump.

Referring to FIG. 7, housing of pump 24 comprises three parts: an upper housing part 40, a middle housing part 42, and a lower housing part 44. Intake port 14 is formed in upper housing part 40, and discharge port 30 is formed in lower housing part 44. Pump 24 houses an impeller 48 and an electric motor 46 adapted to drive impeller 48. Electric motor 46 may be enclosed by motor cover 50 and motor mount 52, which seal the motor to protect it from the moisture. Impeller 48 may be an open impeller, a semi-open impeller, or a closed impeller and may contain one or more vanes. Impeller 48 is closely fitted to middle housing part 42 to maximize the pressure differential between upper housing part 40 and lower housing part 44, thus increasing suction at inlet port 14.

When electric motor 46 is operating, it drives impeller 48 at a pre-determined angular velocity. Rotation of impeller 48 increases pressure in lower housing part 44 and reduces pressure in upper housing part 40—the pressure differential creates a suction through inlet port 14. Since inlet port 14 is fluidly coupled to condensation drain conduit 16, the suction produced by spinning impeller 48 extracts condensate, debris, sludge, fungus, algae, and other contaminants from condensation drain conduit 16 to prevent formation of buildup and clogging. Extracted matter passes through inlet port 14 and enters impeller 48 along its rotating axis. Impeller 48 accelerates the extracted matter and forces it to flow radially into a volute chamber located in lower housing part 44. The extracted matter is then discarded from pump 24 through discharge port 30.

After pump 24 has operated for a predetermined duration of time sufficient to clear out condensation drain conduit 16, control module 26 deactivates electric motor 46. Pump 24 remains deactivated until the next scheduled operation. In-between operations, gravity causes the condensate to drain normally, whereby condensate exits condensation drain conduit 16 and then enters inlet port 14, passes through stationary impeller 48, and exits through discharge port 30. Even if pipe clearing apparatus 10 becomes non-operational, the existing drainage system will not be negatively affected since the condensate will continue to drain.

Referring to FIG. 4, control module 26 is programmable to actuate pump 24 at predetermined times to clear out condensation drain conduit 16. Control module 26 may be programmed to specify frequency, duration, and the start time of prophylactic clearings. These parameters depend on a number of variables including climate, type of the AC system, number of hours the AC system operates, diameter and length of condensation drain conduit 16, etc. Control module 26 may further have an LCD display 34 and a plurality of buttons 36 to facilitate intuitive programming.

An embodiment of the invention depicted in FIGS. 3 and 4 also includes thermostat 28 in electrical communication with vacuum pump 24. It is undesirable for pipe clearing apparatus 10 to operate when the outside temperature falls below the freezing point because ice may form in condensation drain conduit 16 and may damage pump 24. Moreover, since condensate continuously drains through pump 24, in freezing temperatures, the condensate may freeze within pump 24, which may cause damage if pump 24 is actuated. Accordingly, the thermostat 28 will not permit actuation of pump 24 until the temperature rises to an acceptable level.

In an alternative embodiment, control module 26 may be programmable to adjust the frequency of periodic clearings of condensation drain conduit 16 based on the outside temperature detected by a thermal sensor. When the outside temperature rises, the AC unit typically operates for prolonged time periods, consequentially producing more condensation and necessitating more frequent and/or longer clearings. Control module 26 may be programmed to actuate pump 24 according to the outside temperature to account for the increased activity of the AC unit.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

GLOSSARY OF TERMS

Automatic—working by itself with no direct human control other than initial programming of a set of instructions.

Control module—a module containing one or more electrical switches that may be selectively closed to allow electrical current to flow to a component in electrical communication with the control module.

Conduit—a tube for conveying a fluid, a pipe.

Discharge port—an opening through which fluid exits.

Drain conduit—a conduit through which fluid exists a system.

Electric motor—an electric machine that convers electricity to mechanical work.

Electrical communication—an electrical connection between at least two components where the electrons may flow between the components.

Electrical power source—an element capable of providing an electric current.

Fluid coupling—a sealed connection whereby fluid may flow but cannot escape through the connection junction.

Housing—a structure at least partially inclosing an amount of space adapted to contain components of a device.

Inlet port—an opening through which fluid enters.

Impeller—a rotor adapted to initiate or increase a flow of a fluid.

Sealingly—not permitting fluids to enter or exit.

Suction—a partial vacuum that causes a fluid to flow into a space where the partial vacuum is created.

Thermostat—a device that senses the ambient temperature.

Vacuum pump—a device that produces suction.

What is claimed is:

1. A pipe clearing apparatus comprising:

a housing;

a vacuum pump housed within the housing, the vacuum pump having an inlet port and a discharge port, the inlet port configured to fluidly couple to a drain conduit;

a control module in electrical communication with the vacuum pump, the control module actuating the vacuum pump, thereby creating a suction at the inlet port extracting contents of the drain conduit; and an electrical power source in electrical communication with the control module, the electrical power source supplying an electric current to the vacuum pump when the vacuum pump is actuated, wherein the apparatus is configured for permanent in-situ operation.

2. A pipe clearing apparatus according to claim 1, further comprising the control module being programmable to automatically actuate the vacuum pump at a predetermined time.

3. A pipe clearing apparatus according to claim 1, further comprising the electrical power source being selected from the group consisting of a photovoltaic module, a battery, an alternating electrical current source, a capacitor, and a combination thereof.

4. A pipe clearing apparatus according to claim 1, further comprising the vacuum pump being selected from the group consisting of an axial-flow pump, a mixed-flow pumps, an internal gear pump, a screw pump, a shuttle block pump, a flexible vane pump, a sliding vane pump, a circumferential piston pump, a flexible impeller pump, a helical twisted roots pump, a liquid ring pump, and a combination thereof.

5. A pipe clearing apparatus according to claim 1, further comprising a thermostat in an electrical communication with the vacuum pump, the thermostat preventing actuation of the vacuum pump when the ambient temperature is below a predetermined temperature.

6. A pipe clearing apparatus according to claim 1, wherein the vacuum pump comprises: a vacuum pump housing; an impeller rotatably disposed within the vacuum pump housing; an electric motor disposed within the vacuum pump housing in electrical communication with the control module, the electric motor driving the impeller, whereby rotation of the impeller causes a fluid to flow into the vacuum pump housing through the inlet port and exit through the discharge port.

7. A pipe clearing apparatus according to claim 2, further comprising a motor cover enclosing the electrical motor, thereby protecting the electrical motor from liquids within the vacuum pump housing.

8. A pipe clearing apparatus according to claim 1, further comprising the drain conduit being a condensation drain conduit of an air-conditioning system.

* * * * *